US008167340B2

(12) United States Patent
Olivier, III

(10) Patent No.: US 8,167,340 B2
(45) Date of Patent: May 1, 2012

(54) DRILL STEM TUBULAR CONNECTION WITH INTERNAL STIFFENER RING

(75) Inventor: Wilkinson L. Olivier, III, New Iberia, LA (US)

(73) Assignee: Hunting Energy Services, Inc., Houston, TX (US)

( * ) Notice: Subject to any disclaimer, the term of this patent is extended or adjusted under 35 U.S.C. 154(b) by 416 days.

(21) Appl. No.: 12/592,027

(22) Filed: Nov. 18, 2009

(65) Prior Publication Data

US 2011/0115218 A1 May 19, 2011

(51) Int. Cl.
*F16L 15/08* (2006.01)
*F16L 25/12* (2006.01)

(52) U.S. Cl. ..... 285/334; 285/333; 285/334.1; 285/334.2; 285/383

(58) Field of Classification Search ..... 285/333, 285/334, 383, 334.1, 334.2
See application file for complete search history.

(56) References Cited

U.S. PATENT DOCUMENTS 2,098,669 A * 11/1937 Moffitt ..... 285/55
2,211,173 A * 8/1940 Shaffer ..... 285/148.7
3,167,333 A 1/1965 Hall et al.
3,298,716 A * 1/1967 Taylor et al. ..... 285/55
3,345,084 A 10/1967 Hanes et al.
3,479,059 A * 11/1969 Taylor et al. ..... 285/55
3,596,931 A * 8/1971 Mishler ..... 285/55
3,863,963 A * 2/1975 Hershey ..... 285/334
4,002,359 A 1/1977 Lari
4,029,345 A * 6/1977 Romanelli ..... 285/334.2
4,174,124 A 11/1979 Dockree
4,525,001 A 6/1985 Lumsden et al.
4,629,225 A 12/1986 Rowsey
4,900,066 A 2/1990 Brammer et al.
5,282,652 A * 2/1994 Werner ..... 285/55
6,712,402 B2 3/2004 Winship
6,863,313 B1 * 3/2005 DeLange et al. ..... 285/55
7,909,368 B2 * 3/2011 Zapata ..... 285/383

* cited by examiner

*Primary Examiner* — James Hewitt
(74) *Attorney, Agent, or Firm* — Charles D. Gunter, Jr.

(57) ABSTRACT

A threaded pipe coupling is shown for a drill pipe used in horizontal boring operations utilizing a special form of a threaded connection with an internal stiffener ring which eliminates the need for hot forging operations. The pipe coupling is used for joining an upset region of a first tubular member to a further tubular member of lesser external diameter. The internal stiffener ring is received within the internal bore of the pin end of the coupling and underlies and extends along a portion of its length. The stiffener ring having an innermost extent terminating in an exposed end which is received upon an internal shoulder provided in the mating internally threaded box end. The stiffener ring also has an external shoulder formed at the innermost extent thereof which traps the pin face between the ring exterior and the box threaded interior.

7 Claims, 2 Drawing Sheets

DRILL STEM TUBULAR CONNECTION WITH INTERNAL STIFFENER RING

BACKGROUND OF THE INVENTION

1. Field of the Invention

The present invention relates generally to tubular members such as those used to form a drill stem for use in horizontal directional drilling operations and to a coupling and a coupling technique for increasing the applicable torque that such drill stem members can withstand.

2. Description of the Prior Art

In today's world, there are numerous examples of underground conduits, lines and cables which surround us and which enable many of our everyday activities. For example, there are utility lines for water, electricity, gas, telephone, cable television, digital communication and computer connections. It is oftentimes preferable to bury these lines for reasons of safety and aesthetics instead of, for example, running physical pipelines above ground or electrical lines and cables overhead. In many situations, the underground utilities can be buried in a trench, which is subsequently back-filled. Trenching is most advantageously used in areas of new construction. In areas where an existing infrastructure is already in place, however, a trench can cause serious disturbance to structures or roadways. Further, there is always the possibility that digging a trench may damage previously buried utilities, and that structures or roadways disturbed by digging the trench are rarely restored to their original condition. Even in areas of new construction, the burial of utilities in a trench has certain disadvantages. For example, the trenching operation can pose a danger of injury to workers as well as passing traffic.

For these and other reasons, alternative techniques such as horizontal directional drilling (HDD) operations, sometimes referred to as "trenchless" drilling operations, are becoming ever more popular. In the typical HDD operation, a boring machine is positioned on the ground surface. The boring machine is arranged to drill a hole into the ground at an oblique angle with respect to the ground surface. Fluid may be pumped through the drill string, over the boring tool, and back up the borehole in order to remove cuttings and dirt. After the boring tool reaches the desired depth, the tool is then directed along a substantially horizontal path to create a horizontal borehole. After the desired length of borehole has been obtained, the tool is then directed upwards to break through to the surface. A reamer may then attached to the drill string which is pulled back through the borehole, thus reaming out the borehole to a larger diameter. It is common to attach a utility line or conduit to the reaming tool so that it is dragged through the borehole along with the reamer during this step in the operation.

A typical horizontal directional drilling machine includes a frame on which is mounted a drive mechanism that can be slidably moved along the longitudinal axis of the frame. The drive mechanism is adapted to rotate a drill string about its longitudinal axis. Sliding movement of the drive mechanism along the frame, in concert with the rotation of the drill string, causes the drill string to be longitudinally advanced into or withdrawn from the ground.

The length of the desired bore being drilled will vary according to the job at hand but may be substantial. In order to create a drill string of sufficient length to create the desired bore, many fixed lengths of drill rods may be attached end-to-end. More particularly, a first drill rod is placed on the machine rack and forced into the ground. A subsequent length of drill rod is placed on the machine and coupled to the first length, generally via threads on each drill rod. The combined length is then further forced into the ground. In order to form a complete bore, numerous drill rods are added in this fashion during the boring operation. As rods are added, the drill string length and the resulting bore length increases.

When two drill pipes are threaded together in the process of forming such a drill string, they are torqued to a predetermined torque (i.e., the makeup torque) to provide a secure connection. During drilling operations, the drill string is typically rotated in a forward direction (e.g., clockwise). Thus, assuming the pipes have right-hand threads, the forward rotation of the drill string encourages the pipes to remain threaded together. However, at times it is desirable to rotate the drill string in a reverse direction (e.g., counterclockwise). During this reverse rotation, the drill pipes are encouraged to become uncoupled. This is particularly true if the drill head of the drill string becomes wedged in hard soil or rock. It is important that the sections of drill pipe not become uncoupled. For example, if two of the drill pipes become uncoupled, a gap is formed in the threaded joint between the pipes that allows foreign matter to enter the joint. Until the foreign matter is removed, the matter can prevent the joint from being sufficiently retorqued. The loose joint will not be able to carry any reverse rotational torque load unless it is retorqued. If the uncoupling occurs underground, it may be difficult to identify that a joint has become loose and the operation and/or steering of the horizontal directional drilling machine can be negatively effected.

The situation is further complicated by the fact that the forces on pipe used for directional drilling are different than those encountered in vertical drilling operations. HDD pipe must be more flexible than pipe used in vertical drilling because it must bend in ways that are not required in vertical drilling. Pipe for HDD may be subject to more wear because it is supported by the bore wall during drilling and backreaming, and it may also encounter greater pullback and rotational forces than vertical pipe. Thus, the drill pipe utilized in these guided boring operations must be rigid enough to transmit torque, yet flexible enough to negotiate gradual turns as the direction of the bore hole changes. Generally, the flexibility of the drill pipe increases as the diameter of the pipe decreases. So, to improve flexibility, a smaller diameter pipe is preferred.

However, given the high working stresses at work in these operations, it is also true that as the diameter of the pipe, particularly in critical areas of the drill stem decreases, that the failure rate in these areas increases. To reduce likelihood of drill stem failure and yet provide good flexibility, current manufacturing methods include upsetting or expanding the ends of the shaft of the drill pipe by hot or cold forging techniques so larger diameter pin and box joints can be attached. The use of larger joints attached to the upset ends of smaller tubing has resulted in a more durable pipe design. However, the heat forging process typically used for deforming the ends of the drill pipe is time consuming and expensive because it requires high heat and multiple operations. Cold forging processes are also expensive.

Accordingly there is a need for a simpler and more economical method for providing an upset end of a tubular drill stem member used in HDD operations.

There is also a need to develop improved structures and techniques which allow the drill stem to be adequately torqued for any eventual situation which may be encountered in the drilling operation at hand.

A need may also exist to increase the overall rigidity of the joint between drill stem tubular members in some circumstances.

SUMMARY OF THE INVENTION

The present invention has as its primary object to provide a solution to many of the previously mentioned deficiencies noted in the prior art in the form of an improved connection for a tubular member of the type used in manufacturing a drill stem for HDD operations.

The present invention has as a further object to provide a method for making drill pipe for use in horizontal boring operations utilizing a special form of a threaded connection or coupling with an internal stiffener ring which eliminates the need for hot forging operations, or the like. By eliminating the use of these more elaborate manufacturing processes, the present invention makes the manufacturing process simpler, faster and therefore less expensive.

Another object of the invention is to provide a design which increases the allowable torque between the pin and box members used in forming a tubular coupling or connection by increasing the shoulder contact areas of the connection. Such an improved design will allow the drill stem to be adequately torqued for any eventual situation which may be encountered in the drilling operation at hand.

Another object of the present invention is to increase the rigidity of the tubular member in the region under the male member of a joint or connection in order to distribute stresses caused by bending of the tubular member in use.

To accomplish these objectives, the present invention provides a threaded pipe coupling for joining an upset region of a first tubular member to a further tubular member of lesser external diameter, the first and further tubular members making up a length of drill stem of the type used in horizontal directional drilling operation. The pipe coupling of the invention includes an internally threaded box end on the first tubular member containing the upset region which mates with an externally threaded pin end of the further tubular member. The first tubular member has an internal bore and an external diameter, the further tubular member also having an internal bore and an external diameter which is less than the external diameter of the first tubular member for at least a portion of its length. The externally threaded pin end terminates in an exposed pin face.

An internal stiffener ring is received within the internal bore of the pin end and underlies and extends along a portion of the length thereof. The stiffener ring has an innermost extent terminating in an exposed end which is received upon an internal shoulder provided in the internally threaded box end. The stiffener ring also has an external shoulder formed at the innermost extent thereof which traps the pin face between the ring exterior and the box threaded interior. Selected radii and angles present on the box internal shoulder, the stiffener ring exposed end, and between the pin face and the stiffener ring external shoulder provide improved control over the forces encountered during joint makeup and during drilling operations.

The exposed end of the internal stiffener ring forms an obtuse angle $\alpha$ with respect to a centerline of the connection and of the stiffener ring internal diameter, the internal shoulder provided in the internally threaded box end being tapered at a complimentary angle to the angle of the stiffener ring exposed end. The stiffener ring external shoulder which traps the pin face slopes at an acute angle $\beta$ with respect to the centerline of the connection and of the stiffener ring, the pin face being sloped at a complimentary angle so as to contact and mate with the external shoulder of the stiffener ring. The stiffener ring also has an inner radial surface adjacent the innermost extent thereof, the inner radial surface also being selectively tapered to mate with a tapered surface within the internally threaded box end of the first tubular member.

Additional objects, features and advantages will be apparent in the written description which follows.

DETAILED DESCRIPTION OF THE INVENTION

The preferred version of the invention presented in the following written description and the various features and advantageous details thereof are explained more fully with reference to the non-limiting examples included in the accompanying drawings and as detailed in the description which follows. Descriptions of well-known components and processes and manufacturing techniques are omitted so as to not unnecessarily obscure the principal features of the invention as described herein. The examples used in the description which follows are intended merely to facilitate an understanding of ways in which the invention may be practiced and to further enable those skilled in the art to practice the invention. Accordingly, the examples should not be construed as limiting the scope of the claimed invention.

The basic operating environment of one preferred form of the invention will now be described with respect to FIG. 1 of the drawings which shows a typical commercially available horizontal directional drilling (HDD) machine. However, it should be noted that while this invention will be described herein in a preferred form as applied to horizontal boring operations, the invention may also have application to other types of drill pipe such as that used in vertical drilling operations, in some circumstances.

Figure 1:
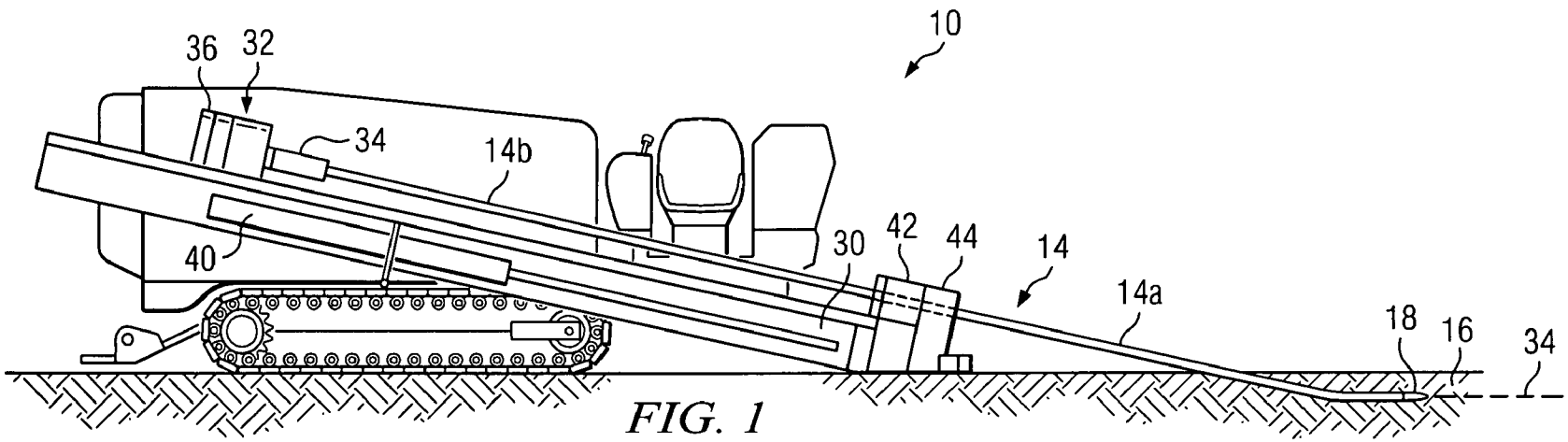
FIG. 1 (PRIOR ART)
FIG. 1 shows a horizontal directional drilling machine which uses the drill stem tubular members constructed in accordance with the principles of the present invention.

The directional drilling machine 10 shown in FIG. 1 is adapted for pushing a drill string 14 into the ground 16, and for pulling the drill string 14 from the ground 16. The drill string 14 includes a plurality of elongated tubular members, e.g., 14*a* and 14*b* that are connected in an end-to-end relationship. A drill head 18 is preferably mounted at the far end of the drill string 14 to facilitate driving the drill string 14 into the ground 16. The dill head 18 can include, for example, a cutting bit assembly, a starter rod, a fluid hammer, a sonde holder, as well as other components. Preferably, each of the elongated members 14*a* and 14*b* includes a threaded male or pin end (shown as 20 in FIG. 2) positioned oppositely from a threaded female box end 22. To couple the elongated members 14*a* and 14*b* together, the male end 20 of the elongated member 14*a* is threaded into the female end 22 of the elongated member 14*b* to provide a threaded coupling or joint.

Figure 2:
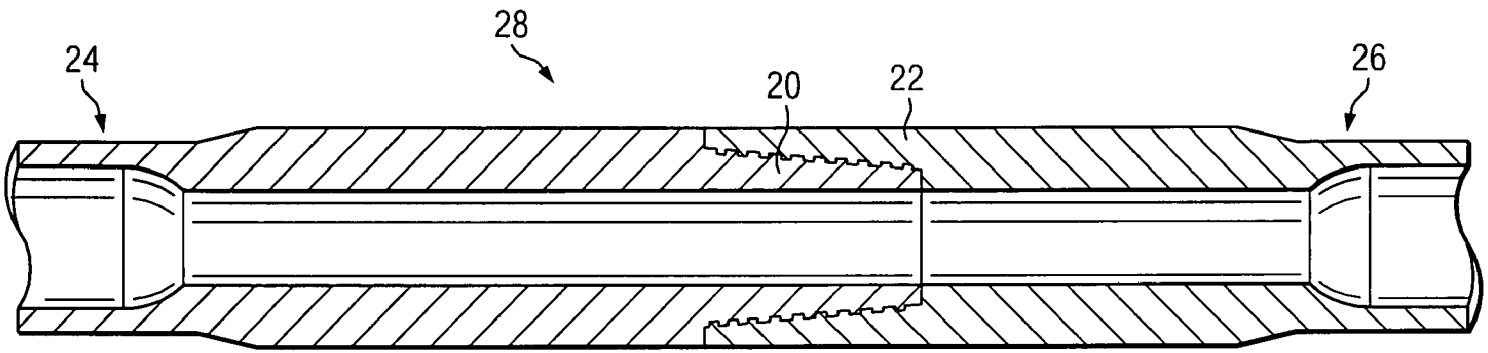
FIG. 2 (PRIOR ART)
FIG. 2 is a side, cross sectional view of the drill stem upset area of a prior art drill stem tubular member of the type under consideration.

It should be noted that, with respect to the prior art tubular member show in FIG. 2, that the pin end 20 and box end 22 are formed in an upset region of the tubular member. Thus, the mid region of the tubular member shown in FIG. 2 is of larger external diameter than the continuation of either of the respective opposing ends 24, 26 thereof. This upset region, designated generally as 28 in FIG. 2 provides greater strength in the threaded region of the connection.

Returning again briefly to FIG. 1, the particular directional drilling machine 10 illustrated includes an elongated guide or track 30 that can be positioned by an operator at any number of different oblique angles relative to the ground 16. A rotational driver 32 is mounted on the track 30. The rotational driver 32 is adapted for rotating the drill string 14 in forward and reverse directions about a longitudinal axis 34 of the drill string 14. As used herein, the terms "forward direction" or "forward torque" are intended to mean that the drill string is rotated in a direction that encourages the elongated members 14*a* and 14*b* to thread together. For example, if the elongated members 14*a* and 14*b* have right-hand threads, the forward direction of rotation or torque is in a clockwise direction. By contrast, the terms "reverse direction" or "reverse torque" are intended to mean that the drill string is rotated in a direction that encourages the elongated members 14*a* and 14*b* to unthread from one another. For example, if the elongated members 14*a* and 14*b* include right-hand threads, the reverse direction or reverse torque is oriented in a counterclockwise direction.

In known fashion, the rotational driver 32 includes a gear box having an output shaft 34 (i.e., a drive chuck or a drive shaft). The gear box is powered by one or more hydraulic motors 36. While a hydraulic system has been shown, it will be appreciated that any number of different types of devices known for generating torque could be utilized.

The rotational driver 32 is adapted to slide longitudinally up and down the track 30. For example, the rotational driver 32 can be mounted on a carriage (not shown) that slidably rides on rails (not shown). A thrust mechanism 40 is provided for propelling the rotational driver 32 along the track. For example, the thrust mechanism 40 moves the rotational driver 32 in a downward direction to push the drill string 14 into the ground 16. By contrast, the thrust mechanism propels the rotational driver 32 in an upward direction to remove the drill string 14 from the ground 16. It will be appreciated that the thrust mechanism 40 can have any number of known configurations such as, for example, a chain drive mechanism. Directional drilling machines having a chain drive arrangement as described above are well known in the art. For example, such chain drive arrangements are used on numerous directional drilling machines manufactured by Vermeer Manufacturing Company of Pella, Iowa.

Referring again to FIG. 1 of the drawings, the drilling machine 10 further includes upper and lower gripping units 42, 44 for use in coupling and uncoupling the elongated members 14*a* and 14*b* of the drill string 14. The upper gripping unit 42 includes a drive mechanism such as a hydraulic cylinder for rotating the upper gripping unit about the longitudinal axis 34 of the drill string 14. The gripping units 42, 44 can include any number of configurations adapted for selectively preventing rotation of gripped ones of the elongated members 14*a* and 14*b*. For example, the gripping units 42, 44 can be configured as vice grips that when closed grip the drill string 14 with sufficient force to prevent the drill string 14 from being rotated by the rotational driver 32. Alternatively, the gripping units 42, 44 can include wrenches that selectively engage flats provided on the elongated members 14*a* and 14*b* to prevent the elongated members from rotating.

Figure 3:
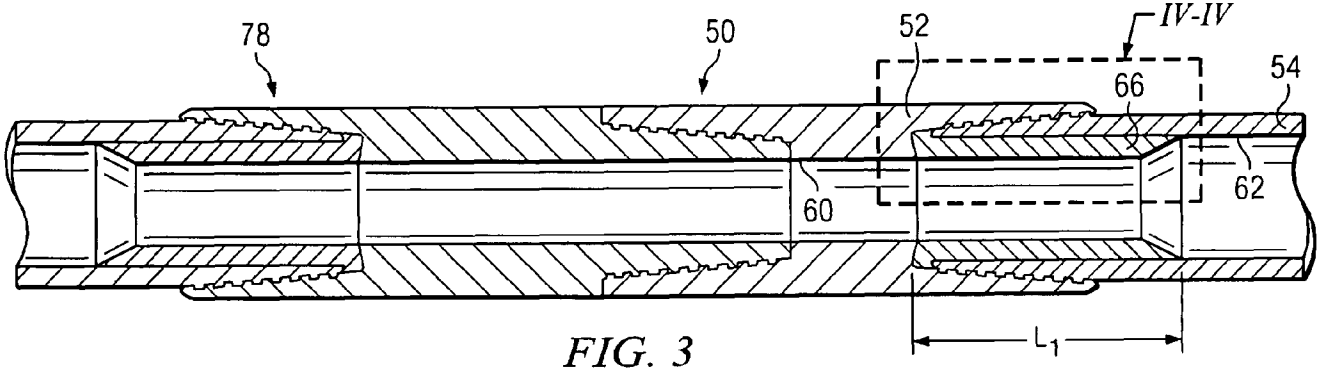
FIG. 3 is a side, cross sectional view similar to FIG. 2, but of the improved drill stem tubular member of the invention.
Figure 5:
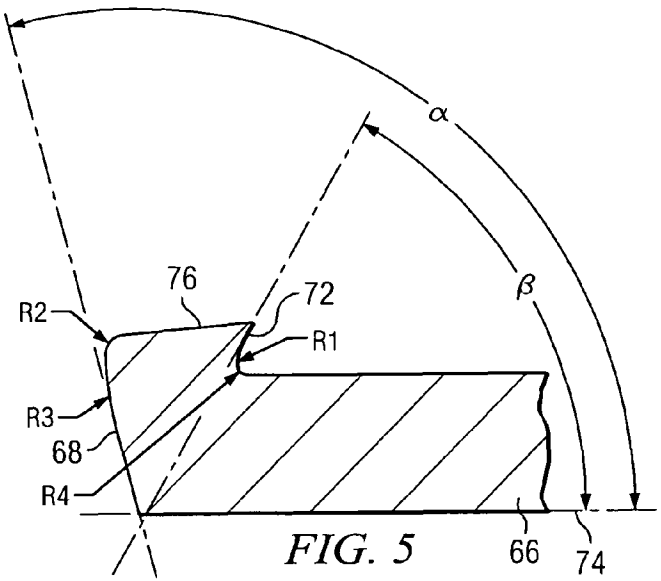
FIG. 5 is an isolated view of one end of the stiffener ring insert used in forming the threaded coupling in the tubular drill stem member of FIG. 3.
Figure 4:
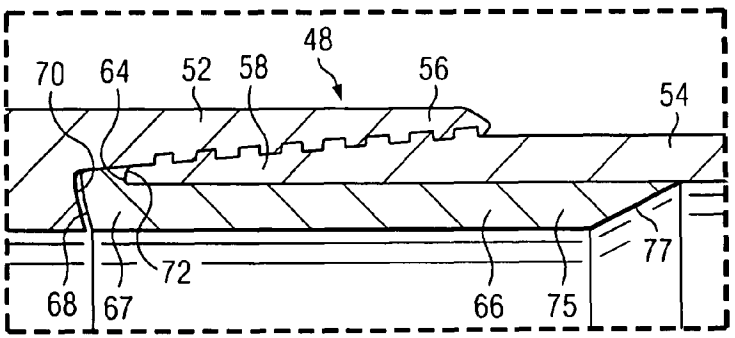
FIG. 4 is a quarter sectional, close-up view of the threaded coupling of the invention as taken along lines IV-IV in FIG. 3.

It will be appreciated from the foregoing that the threaded connections between tubular members are subjected to significant torque forces during make up of a HDD drill stem. The upset region (indicated as 28 in FIG. 2) provides added strength in this critical area of the connection. FIGS. 3-5 of the drawings show Applicant's improved design for a tubular member of the type described. In the example illustrated in FIG. 3, the tubular member 46 includes a special threaded pipe coupling which is shown in close-up fashion as 48 in FIG. 4 of the drawings. The special threaded pipe coupling is used for joining an upset region (50 in FIG. 3) of a first tubular member 52 to a further tubular member 54 of lesser external diameter. The first and further tubular members, 52 and 54, respectively, make up a length of drill stem of the type used in HDD operations of the type previously described.

As best seen FIG. 4, the special coupling of the invention includes an internally threaded box end 56 on the first tubular member 52 containing the upset region which mates with an externally threaded pin end 58 of the further tubular member 54. The first tubular member 52 has an internal bore (60 in FIG. 3) and an external diameter. The further tubular member 54 also has an internal bore 62 and an external diameter which is less than the external diameter of the first tubular member for at least a portion of its length.

The pin end of the coupling terminates in an exposed pin face (64 in FIG. 4). An internal stiffener ring (66 in FIGS. 3 and 4) is received within the internal bore 62 of the pin end. The stiffener ring 66 is a generally cylindrical sleeve which underlies and extends along a portion of the length of the bore 62 (illustrated as "$L_1$" in FIG. 3). The stiffener ring 66 has an innermost extent 67 which terminates in an exposed end 68 which is received upon an internal shoulder 70 provided in the internally threaded box end 52. The stiffener ring 66 also has an external shoulder 72 formed at the innermost extent 67 thereof which traps the pin face between the ring exterior and the box threaded interior. Selected radii and angles present on the box internal shoulder 70, the stiffener ring exposed end 68, and between the pin face 64 and the stiffener ring external shoulder 72 provide improved control over the forces encountered during joint makeup and during drilling operations.

FIG. 5 of the drawings shows the preferred angles and radii which have been selected for one preferred embodiment of the invention. In the example illustrated in FIG. 5, the angles and radii are as follows:

| α | β | R1 | R2 | R3 | R4 |
|---|---|---|---|---|---|
| 105° | 60° | 0.0606 inch | 0.0350 inch | 0.4870 inch | 0.0156 inch |

As will be appreciated from FIG. 5, and the above numerical parameters, the exposed end 68 of the internal stiffener ring 66 forms an obtuse angle α with respect to a centerline 74 of the connection and of the stiffener ring internal diameter. The internal shoulder 70 provided in the internally threaded box end is tapered at a complimentary angle to the angle of the stiffener ring exposed end. The stiffener ring external shoulder 72 which traps the pin face slopes at an acute angle β with respect to the centerline of the connection 74 and of the stiffener ring, the pin face being sloped at a complimentary angle so as to contact and mate with the external shoulder of the stiffener ring. The stiffener ring 66 also has an inner radial surface (shown as 76 in FIG. 5) adjacent the innermost extent 67 thereof, the inner radial surface also being tapered slightly to mate with a tapered surface within the internally threaded box end of the first tubular member. In the example shown, the degree of taper of the surface 76 is approximately 0.1667 inch/inch. It will be appreciated that each of the surfaces 68, 70 and 76 forms a metal-to-metal seal as the coupling is made up. The opposite end (75 in FIG. 4) of the stiffener ring 66 terminates in an inwardly tapered surface 77.

In the preferred example illustrated, the angle α is in the range from about 95 to 115° with respect to the centerline of the connection, most preferably about 105°. The angle β is in the range from about 40° to 70°, most preferably about 60° with respect to the centerline of the connection.

While the invention has been described with respect to a single end coupling for the tubular member of FIG. 3, it will be understood that the tubular member 50 will preferably be provided with a second mirror image coupling (designated as 78 in FIG. 3) at the opposite end thereof.

In operation, the internal stiffener ring 66 is first installed on the end of the pin 58 and the pin end is then threadedly engaged within the box 52 to make-up the coupling. As the initial contact is made between the exposed pin face 64 and the external shoulder 72 on the stiffener ring, the make-up forces tend to force the pin into the external surface of the stiffener ring trapping it between the ring and the box connection, rather than allowing it to flare out and escape, i.e., the force directs the pin end nose radially inward toward the internal diameter of the box end. As make-up continues, the forces are directed back into the rear, stronger region of the box end.

An invention has been provided with several advantages. The use of the stiffener ring of the invention results in a coupling for a tubular member that increases the applicable torque that the tubular connection can withstand, while also increasing the rigidity of the tubular member under the male member to distribute stresses caused by bending of the tubular product. The ring is designed in such a way as to have angular or radial shoulders in contact with both the male and female tubular connection members with an integral sleeve extending under the male connection member. The presence of the internal stiffener ring increases the shoulder area of the connection by trapping the pin faced between the box shoulder via radii and angular shoulders. A by-product of the design is the increasing rigidity of the ultimate joint.

While the invention has been shown in only one of its forms, it is not thus limited but is susceptible to various changes and modifications without departing from the spirit thereof.

What is claimed is:

1. A length of drill stem used in horizontal directional drilling operations, the length of drill stem comprising:

a first pair of joined elongate tubular members which terminate in first and second opposing outer ends, the elongate tubular members each having an internal bore and a selectively sized external diameter, the elongate tubular members being joined together by a pin and box threaded connection located between the opposing outer ends thereof;

wherein at least a selected end of one of the elongate tubular members has a threaded pipe coupling which connects the selected end of the one elongate tubular member to a further tubular member used to make up the length of drill stem, the further tubular member having an internal bore and an external diameter which is less than the external diameter of the first pair of elongate tubular members so that, upon connection of the further tubular member to the first pair of elongate tubular members, the external diameter of the first pair of elongate tubular members forms an upset region in the pipe, the upset region containing the pin and box threaded connection; and wherein the threaded pipe coupling comprises an internally threaded box end on the selected end of the one elongate tubular member which mates with an externally threaded pin end on the further tubular member, wherein the pin end terminates in an exposed pin face, and wherein an internal stiffener ring is received within the internal bore of the pin end and which underlies and extends along a portion of the length thereof, the stiffener ring having an innermost extent terminating in an exposed end which is received upon an internal shoulder provided in the internally threaded box end, the stiffener ring also having an external shoulder formed at the innermost extent thereof which traps the pin face between the ring exterior and the box threaded interior;

wherein the exposed end of the internal stiffener ring forms an obtuse angle α with respect to a centerline of the connection and of the stiffener ring, the internal shoulder provided in the internally threaded box end being tapered at a complementary angle to the angle of the stiffener ring exposed end, and wherein the stiffener ring external shoulder which traps the pin face slopes at an acute angle β with respect to the centerline of the connection and of the stiffener ring, the pin face being sloped at a complementary angle so as to contact and mate with the external shoulder of the stiffener ring;

whereby, upon make up of the drill stem, and initial contact is made between the pin exposed face and the external shoulder of the stiffener ring, the make up forces tend to force the pin nose radially in the direction of the internal diameter of the stiffener ring thereby trapping the pin and stiffening the further tubular member, rather than allowing the pin nose to disengage from the internally threaded box end of the coupling or climb the shoulder of the ring.

2. The length of drill stem of claim 1, whereupon continued make up of the coupling causes the stiffener ring exposed end to act upon the internal shoulder to exert axial forces on a stronger, larger diameter region of the box end of the coupling.

3. The length of drill stem of claim 1, wherein both of the opposing ends of the connected elongate tubular members are provided with a threaded pipe coupling which connects a selected end of the elongate tubular member to a further tubular member used to make up the length of drill stem.

4. The length of drill stem of claim 1, wherein the stiffener ring also has an inner radial surface adjacent the innermost extent thereof, the inner radial surface also being tapered slightly to mate with a tapered surface within the internally threaded box end of the first tubular member.

5. The length of drill stem of claim 4, wherein the angle α is in the range from about 95 to 115° with respect to the centerline of the connection.

6. The length of drill stem of claim 5, wherein the angle β is in the range from about 40 to 70° with respect to the centerline of the connection.

7. The length of drill stem of claim 6, wherein the degree of taper on the inner radial surface of the stiffener ring is on the order of 0.1667 inches/inch of radial surface.

* * * * *